US011662158B2

(12) United States Patent
Forst et al.

(10) Patent No.: US 11,662,158 B2
(45) Date of Patent: May 30, 2023

(54) HEAT EXCHANGER PLATE AND HEAT EXCHANGER COMPRISING SUCH A HEAT EXCHANGER PLATE

(71) Applicant: VALEO VYMENIKY TEPLA S. r. o., Zebrak (CZ)

(72) Inventors: Jan Forst, Zebrak (CZ); Florencio Gonzalez, Zebrak (CZ); Jakub Jirsa, Zebrak (CZ)

(73) Assignee: VALEO VYMENIKY TEPLA S. r. o.

( * ) Notice: Subject to any disclaimer, the term of this patent is extended or adjusted under 35 U.S.C. 154(b) by 0 days.

(21) Appl. No.: 17/261,311

(22) PCT Filed: Jul. 10, 2019

(86) PCT No.: PCT/EP2019/068590
§ 371 (c)(1),
(2) Date: Jan. 19, 2021

(87) PCT Pub. No.: WO2020/016082
PCT Pub. Date: Jan. 23, 2020

(65) Prior Publication Data

US 2021/0278136 A1 Sep. 9, 2021

(30) Foreign Application Priority Data

Jul. 20, 2018 (EP) ..... 18184820

(51) Int. Cl.
*F28F 3/04* (2006.01)
*F28D 1/03* (2006.01)

(52) U.S. Cl.
CPC ..... *F28F 3/042* (2013.01); *F28D 1/0341* (2013.01); *F28F 3/044* (2013.01); *F28F 2225/08* (2013.01)

(58) Field of Classification Search
CPC ..... F28D 1/0341; F28F 3/044; F28F 2225/08; F28F 3/042
See application file for complete search history.

(56) References Cited

U.S. PATENT DOCUMENTS 4,600,053 A * 7/1986 Patel ..... F28D 1/0333 165/153
5,101,891 A * 4/1992 Kadle ..... F25B 39/022 165/152

(Continued)

FOREIGN PATENT DOCUMENTS

DE 19746772 A1 4/1998
EP 0935115 A2 8/1999

(Continued)

OTHER PUBLICATIONS

International Search Report and Written Opinion in corresponding International Application No. PCT/EP2019/068590, dated Oct. 17, 2019 (9 pages).

*Primary Examiner* — Devon Russell
(74) *Attorney, Agent, or Firm* — Osha Bergman Watanabe & Burton LLP

(57) ABSTRACT

The invention relates to a heat exchanger plate (10) of a heat exchanger, the heat exchanger plate (10) comprising two faces (12, 13) extending between two lateral edges and two longitudinal edges (15) of said heat exchanger plate (10). The heat exchanger plate (10) comprises at least an opening (16) extending from a first face (12) to a second face (13) of the heat exchanger plate (10). The opening (16) is delimited by a collar (17) that is arranged around the opening (16). The heat exchanger plate (10) comprises at least a dimple (18) protruding above at least one of the faces (12, 13). Said dimple (18) comprises at least a flat area (19) and a sloped (Continued)

Figure 1:
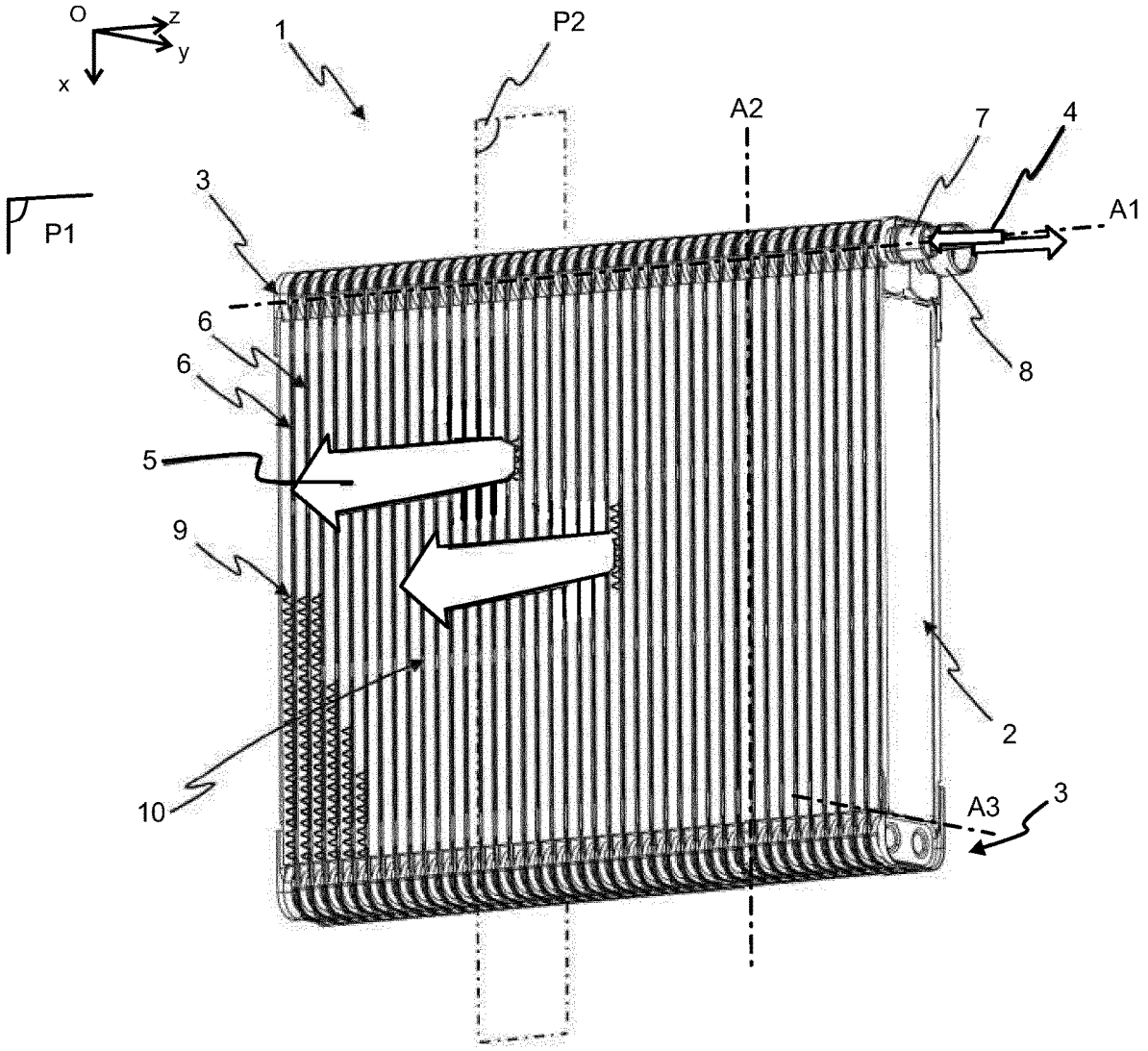

area (20), said sloped area (20) being interposed between the collar (17) and the flat area (19).

10 Claims, 6 Drawing Sheets

(56) References Cited

U.S. PATENT DOCUMENTS 5,111,877 A * 5/1992 Buchanan ..... F28D 1/0341 165/153
5,111,878 A * 5/1992 Kadle ..... F25B 39/022 165/153
5,152,337 A * 10/1992 Kawakatsu ..... F25B 39/022 165/111
5,172,759 A 12/1992 Shimoya et al.
5,409,056 A * 4/1995 Farry, Jr. ..... F28D 1/0341 165/153
5,620,047 A * 4/1997 Nishishita ..... F28D 1/0341 165/153
5,881,805 A * 3/1999 Inoue ..... F28D 1/0341 165/153
6,173,764 B1 * 1/2001 Inoue ..... F28D 1/0341 165/153
6,216,773 B1 * 4/2001 Falta ..... F28D 1/0333 165/153
6,863,120 B2 * 3/2005 Hwang ..... F28D 1/0341 165/153
7,413,003 B2 * 8/2008 Oh ..... F28F 3/044 165/153
7,934,541 B2 * 5/2011 Park ..... F28D 1/0341 165/153
D735,842 S * 8/2015 Cole ..... D23/323
9,103,597 B2 * 8/2015 Christensen ..... F28F 3/046
10,371,454 B2 * 8/2019 Masgrau ..... F28F 3/086
2001/0018969 A1 * 9/2001 Shin ..... F28D 1/0341 165/153
2003/0070797 A1 * 4/2003 Narahara ..... F28D 1/0341 165/182
2006/0231241 A1 * 10/2006 Papapanu ..... F28F 13/06 165/152
2013/0087317 A1 * 4/2013 Papoulis ..... F28F 3/044 165/177

FOREIGN PATENT DOCUMENTS

EP 1715278 A2 10/2006
WO 2009123517 A1 10/2009

* cited by examiner

HEAT EXCHANGER PLATE AND HEAT EXCHANGER COMPRISING SUCH A HEAT EXCHANGER PLATE

The present invention concerns a heat exchanger plate of a heat exchanger for a refrigerant fluid circulation circuit fitted for an automotive vehicle. The object of the present invention is such a heat exchanger plate and a heat exchanger comprising at least one of these plates.

An automotive vehicle is currently equipped with a heating, ventilating and air conditioning system, usually called the HVAC system, for thermally treating the air present in or sent inside a passenger compartment of the automotive vehicle. The HVAC system is associated with a refrigerant fluid circulation circuit inside which a refrigerant fluid circulates. The refrigerant fluid circulation circuit comprises successively a compressor, a condenser or gas cooler, an expansion device and a heat exchanger. The heat exchanger is housed inside the HVAC system to allow a heat exchange between the refrigerant fluid and an air flow that is circulating inside the HVAC system before being delivered inside the passenger compartment.

According to a mode of operation of the refrigerant fluid circulation circuit, the heat exchanger is used as an evaporator to cool down the air flow. In this case, the refrigerant fluid is compressed inside the compressor, then the refrigerant fluid is cooled inside the condenser or gas cooler, then the refrigerant fluid expands within the expansion device and finally the refrigerant fluid cools down the air flow passing through the heat exchanger.

The heat exchanger comprises a plurality of heat exchanger plates that are assembled together to make the heat exchanger. The heat exchanger plate has a rectangular shape and comprises openings that are extending from a first face of the heat exchanger plate to a second face of the heat exchanger plate. The openings are located at extremities or angles of the heat exchanger plate. Each opening is delimited by a collar that is arranged around the opening.

Two heat exchanger plates are joined together to make a tube and several tubes are assembled together to make the heat exchanger plate. The collars of two plates are assembled together as well as longitudinal edges and lateral edges of both heat exchanger plates to realize the tube. Then, the tubes are assembled together to realize the heat exchanger. Finally, the heat exchanger comprises two header boxes, made of the assembled collars, between which a core, made of the extended portion of the heat exchanger plates, is interposed.

Before being used in the refrigerant fluid circuit, the heat exchanger undergoes some tests to check its pressure resistance and to identify any assembling defects. For example, the heat exchanger undergoes pressure tests during which the refrigerant fluid inside the heat exchanger is currently at 100 bars pressure. This test pressure is much higher than a current utilization pressure of the refrigeration fluid that is in a range of 15 bars to 20 bars.

It appears that during the pressure tests the heat exchanger tends to go through differential deformations in the core and the header boxes. More specifically, the header boxes tend to be more extended than the core of the heat exchanger. These differential deformations may generate cracks within the heat exchanger that could provoke refrigerant fluid which is mostly inconvenient.

There is a need to have a heat exchanger comprising heat exchanger plates that are arranged so that no leak appear in order to have a robust and sustainable heat exchanger.

The heat exchanger plate of the invention is a heat exchanger plate of a heat exchanger. The heat exchanger plate comprises two faces extending between two lateral edges and two longitudinal edges of said heat exchanger plate. The heat exchanger plate comprises at least an opening extending from a first face to a second face of the heat exchanger plate. The opening is delimited by a collar that is arranged around the opening. The heat exchanger plate comprises at least a dimple protruding above at least one of the faces.

According to the invention, said dimple comprises at least a flat area and a sloped area, said sloped area being interposed between the collar and the flat area.

The heat exchanger plate is also advantageously characterized by any of the following characteristics, these characteristics being combined or considered alone:

- the lateral edges and the longitudinal edges are perpendicular to each other,
- the lateral edges are parallel to each other.
- the longitudinal edges are parallel to each other,
- the longitudinal edges are longer than the lateral edges,
- the opening is circular.
- the opening is elliptical,
- the heat exchanger plate comprises at least two openings aligned along one of the lateral edges. In one embodiment, the beat exchanger plate comprises four openings each located at an angle of the heat exchanger plate,
- two of the openings are close to a first lateral edge and two of the openings are close to a second lateral edge,
- the heat exchanger plate comprises at least a dimple extending from at least one of the faces,
- the dimple forms a protrusion over one of the faces,
- the dimple is extended along a transversal axis that is perpendicular to the longitudinal edges and the lateral edges,
- the sloped area has a cross-section that has a U-shape form between the flat area and the collar,
- the sloped area has a cross-section that has a S-shape form between the flat area and the collar,
- the cross section is taken in a central plane parallel to the longitudinal edges and perpendicular to lateral edges,
- two heat exchanger plates are assembled together to make a tube of the heat exchanger,
- the collar protrudes with respect to the first face of the heat exchanger plate and the dimple protrudes with respect to the second face of the heat exchanger plate,
- the dimple is located between the collar and a core portion of the heat exchanger plate, the dimple and the core portion being separated by a borderline,
- the borderline is a limit of the heat exchanger plate located between a collecting portion of the heat exchanger plate and the core portion of said heat exchanger plate,
- the collecting portion of the heat exchanger plate comprises at least the collar,
- the collecting portion of the heat exchanger plate is dedicated to permit the circulation of a refrigerant fluid from one tube to another of the heat exchanger,
- the core portion of the heat exchanger plate comprises at least the grooves,
- the core portion of the heat exchanger is dedicated to facilitating the heat exchange between the refrigerant fluid circulating in the heat exchanger and an air flow circulating in the air conditioning system,
- the flat area of the dimple is arranged in a first plane that is parallel to a second plane in which the core portion of the heat exchanger plate is arranged,
- the borderline has a sinusoidal shape, the shape of the borderline is observed from a view point located in a plane parallel to the second plane.

the sloped area being delimited by two opposite side lines, a first distance between both side lines increases from the flat area of the dimple up to the collar, each side line is a limit between the dimple and the core portion of the heat exchanger plate, the side lines are parts of the borderline, the sloped area being a curved area, the curvature center of the curved area is located at a second distance that is bigger than a depth of the dimple, the depth of the dimple is measured between the first plane and the second plane, the sloped area comprises a fringe that is tangent to the collar, the heat exchanger plate comprises a plurality of dimples that are symmetrically arranged versus a central plane that is parallel to the longitudinal edges of the heat exchanger plate and passing by an opening center of the opening, each dimple comprising a summit, the summits of the dimples are arranged on a dimple circle, a center of the dimple circle being the opening center.

a third distance between the opening center of the opening and a limit between the sloped area and the flat area is constant from one dimple to another dimple, the distance between the center of the opening and the limit between the sloped area and the flat area is taken between the opening center of the opening and a middle point of the said limit, that is to say at equal distance of each side lines of the sloped area, a thickness of the sloped area is at least constant from the limit up to the collar.

the thickness of the sloped area is measured between both faces of the heat exchanger plate in die sloped area, perpendicularly of at least one face, the thickness of the sloped area is increasing from the limit up to the collar, the heat exchanger plate comprises at least a groove that is located in the core portion of the heat exchanger plate, the groove is longitudinally extended in a parallel direction to the longitudinal edges, the groove protrudes with respect to the second face of die heat exchanger plate, the groove and the dimple emerge over the same face of the heat exchanger plate, the heat exchanger plate comprises a plurality of grooves, each groove extending from a first longitudinal extremity and a second longitudinal extremity, both longitudinal extremities being located along a groove axis that is parallel to the longitudinal edges of the heat exchanger plate, the summit of the dimple is located in a canal that is delimited by at least a groove.

a dimple is a prolongation of a groove, the flat area of the dimple is a prolongation of a groove, the dimple comprises a chamfer, a width of the chamfer of the sloped area being bigger than a width of the chamfer of the flat area, the sloped area and the flat area are arranged around a line of symmetry that is a straight line.

the sloped area and the flat area are arranged around a line of symmetry that is a curved line.

The invention relates also to a heat exchanger comprising at least one such heat exchanger plate.

The heat exchanger plate is also advantageously characterized by any of the following characteristics, these characteristics being combined or considered alone:

the heat exchanger comprises a first heat exchanger plate and a second heat exchanger plate, the flat area of both heat exchanger plates being in contact with each other, the flat area of both heat exchanger plates are brazed together.

The invention relates also to a refrigerant fluid circulation circuit that comprises at least such a heat exchanger.

The invention relates also to utilization of the heat exchanger as an evaporator in such a refrigerant fluid circulation circuit.

The invention relates also to a method for manufacturing such a heat exchanger plate comprises at least:

a step in which the collar is stamped from the first face of the heat exchanger plate to the second face of the heat exchanger face, a step in which the dimple and the groove are stamped from the second face of the heat exchanger plate to the first face of the heat exchanger face.

Figure 2:
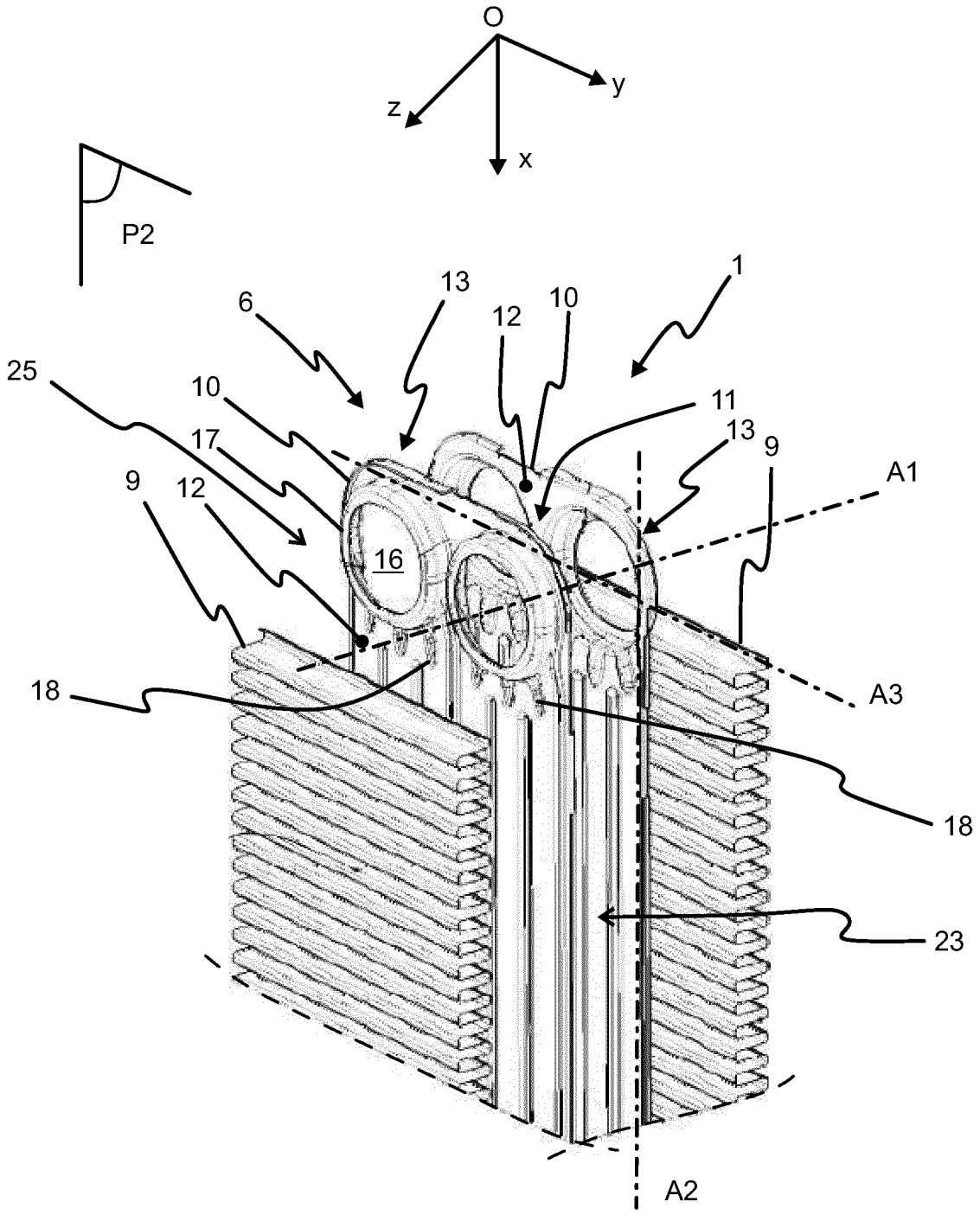
Figure 3:
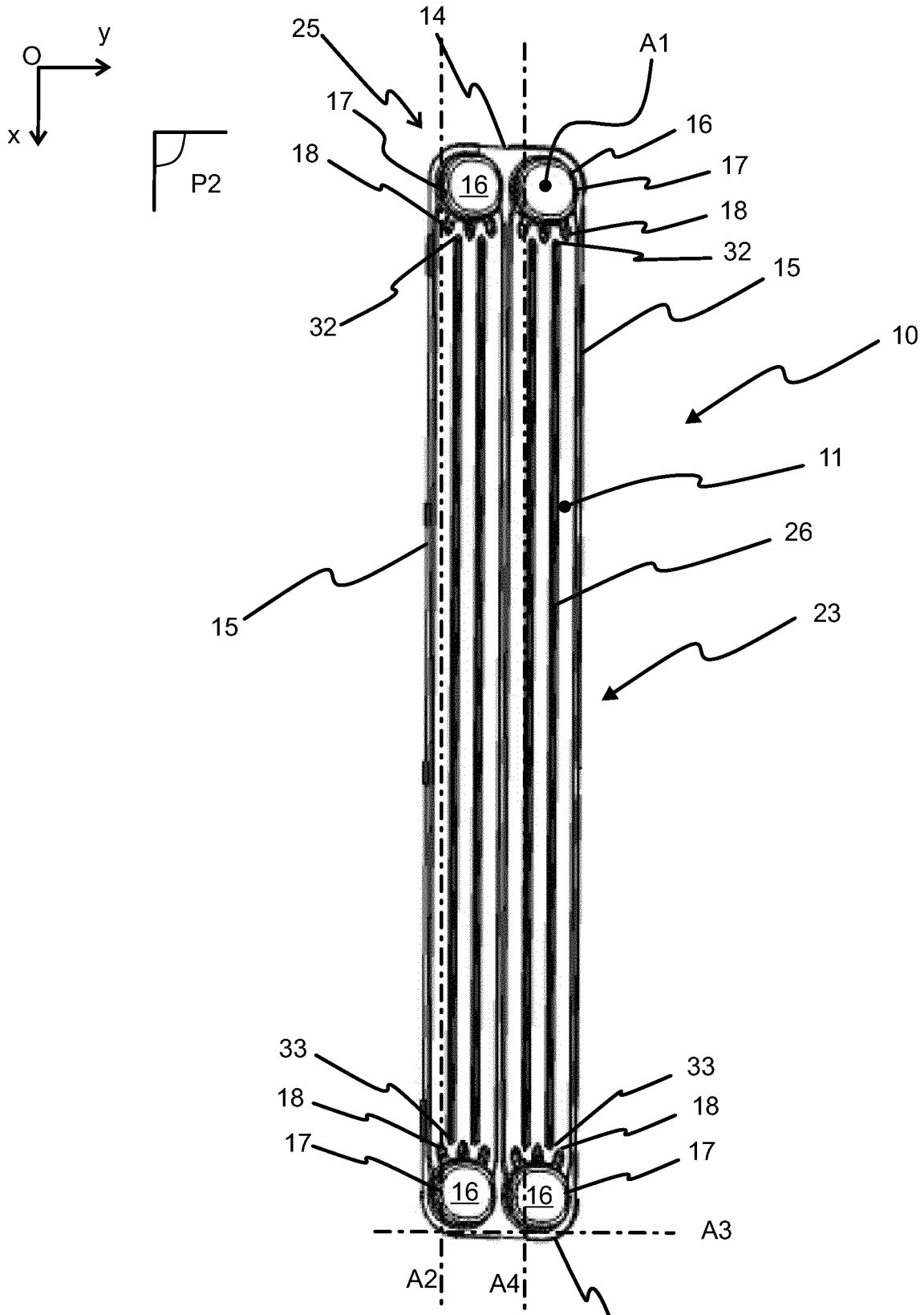
Figure 4:
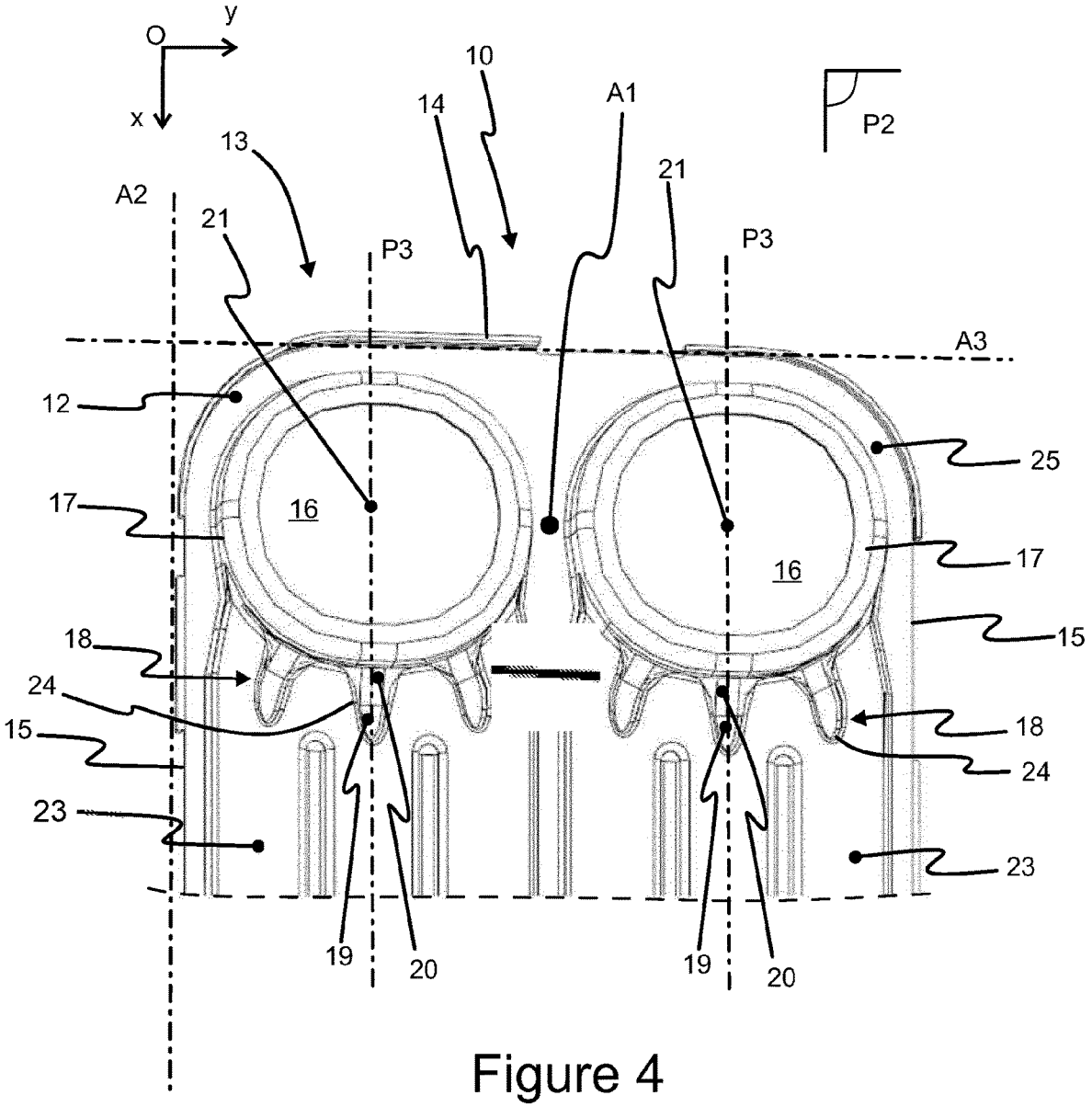
Figure 5:
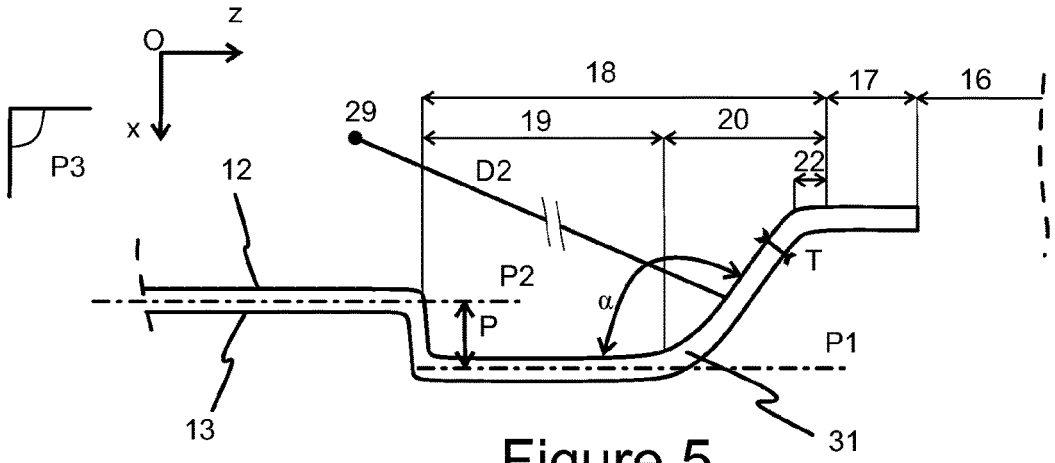
Figure 6:
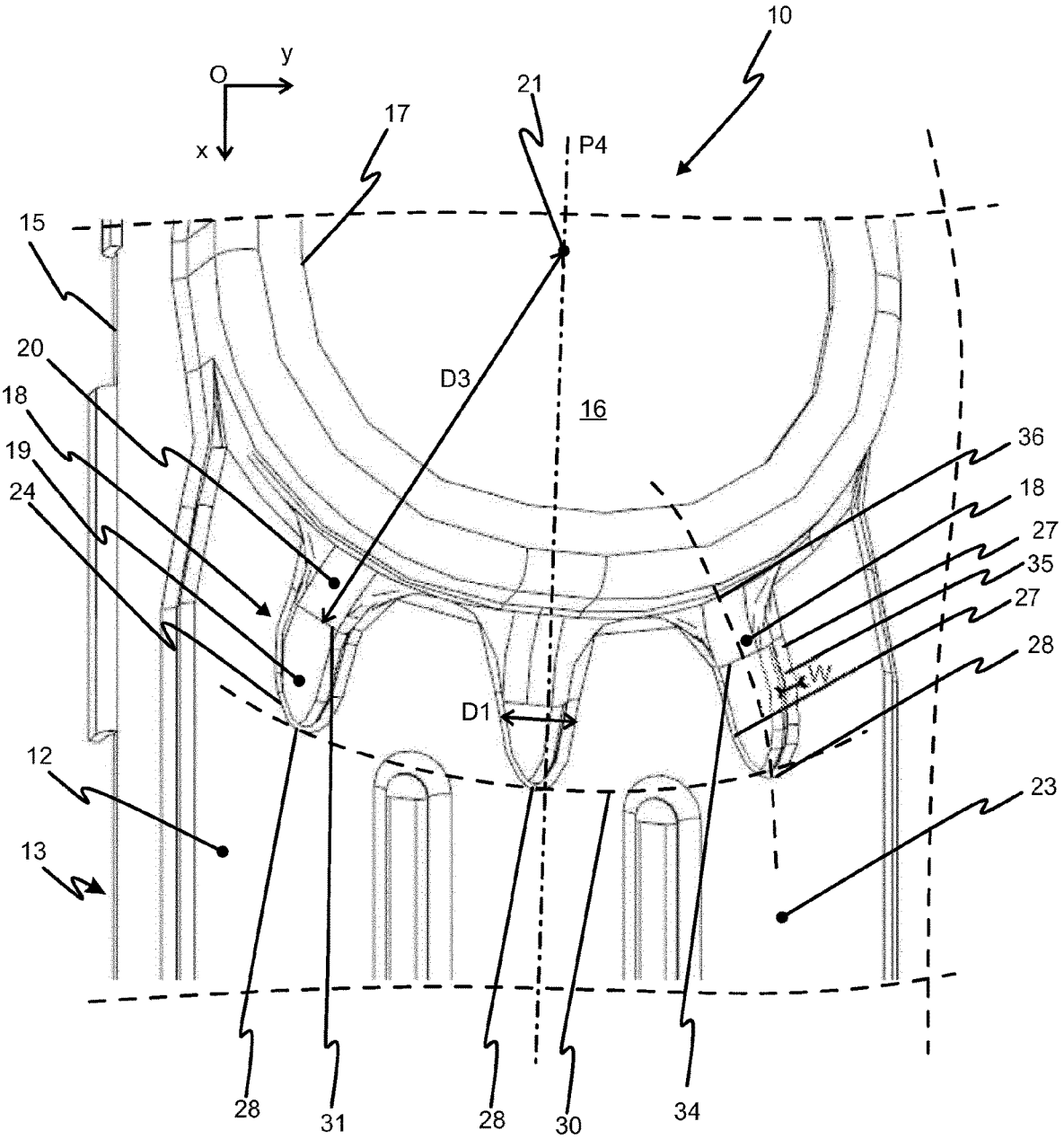

Other specificities, details and characteristics of the present invention will be highlighted thanks to the following description, given for general guidance, in relation with the following figures:

FIG. 1 is a general view of a heat exchanger according to the present invention, FIG. 2 is a partial view of the heat exchanger illustrated in FIG. 1, FIG. 3 is a face view of a heat exchanger plate participating to the heat exchanger illustrated in FIG. 1 or 2, FIG. 4 is a partial view of the heat exchanger plate illustrated in FIG. 3, FIG. 5 is a partial cross-section view of the heat exchanger plate illustrated in FIGS. 3 and 4, FIG. 6 is a partial face view of the heat exchanger plate illustrated in FIGS. 3 to 5, FIG. 7 is a schematic view of a refrigerant fluid circulation circuit comprising the heat exchanger illustrated in FIG. 1.

In the Figures, a heat exchanger 1 according to the invention is shown in a coordinate system Oxyz in which Ox axis is a longitudinal axis, Oy axis is a lateral axis and Oz axis is a transversal axis, the Oxz plane is a longitudinal plane, the Oxy plane is a lateral plane and the Oyz plane is a transversal plane. In the following description, a direction is qualified in accordance with the above mentioned axis and a surface is qualified in accordance with the above mentioned plane.

In FIG. 1, the heat exchanger 1 comprises a core 2 disposed between two header boxes 3. The core 2 is the part of the heat exchanger 1 that is dedicated to enable a heat exchange between a refrigerant fluid 4 circulating in the heat exchanger 1 and an air flow 5 passing through the heat exchanger 1. Both header boxes 3 extend mainly in a transversal direction A1 that is parallel to the Oz axis. The core 2 comprises a plurality of tubes 6 that are interposed between the header boxes 3.

The tubes 6 extend mainly along a longitudinal direction A2 that is parallel to the longitudinal axis Ox. The tubes 6 are also laterally extended along a lateral direction A3 that is parallel to the Oy axis. The lateral direction A3 is also perpendicular to a longitudinal plane P1 of the heat exchanger 1 containing the header boxes 3 and the tubes 6. Therefore, the tubes 6 are disposed in respective planes that are parallel to a lateral plane P2, the lateral plane P2 being perpendicular to the longitudinal plane P1 of the heat exchanger 1. In other words, the tubes 6 altogether form the core 2 that is globally arranged as a parallelepiped.

The heat exchanger 1 is equipped with a refrigerant fluid inlet 7 through which the refrigerant fluid 4 is admitted inside the heat exchanger 1. The refrigerant fluid inlet 7 equips the header box 3. The heat exchanger 1 is also equipped with a refrigerant fluid outlet 8 through which the refrigerant fluid 4 is evacuated from the heat exchanger 1. The refrigerant fluid outlet 8 equips the same header box 3 than the refrigerant fluid inlet 7. Furthermore, the refrigerant fluid inlet 7 and the refrigerant fluid outlet 8 are located on the same longitudinal side of the heat exchanger 1. Therefore, in this embodiment of the invention, the refrigerant fluid 4 circulates along a path that is designed as a U form path. Other localization of the refrigerant fluid inlet 7 and the refrigerant fluid outlet 8 are possible, so that the heat exchanger 1 of the invention may provide a I form path or a W form path or other combinations of path for the refrigerant fluid 4.

The core 2 comprises these tubes 6 and corrugated fins 9 that are separating two contiguous tubes 6, the corrugated fins 9 enhancing the heat exchange between the refrigerant fluid 4 and the air flow 5.

FIG. 2 represents a tube 6 that is a flat tube formed by assembling a pair of heat exchanger plates 10. The heat exchanger plates 10 have globally a rectangular shape that extends in the lateral plane P2. Both heat exchanger plates 10 extend in respective planes parallel to the lateral plane P2, thus making the tube 6 planar. The pair of heat exchanger plates 10 is designed to allow the circulation of the refrigerant fluid in at least a dedicated canal 11. Each heat exchanger plate 10 has a first face 12 and a second face 13 opposed to the first face 12. When the heat exchanger plates 10 are assembled together, the first face 12 of a first heat exchanger plate 10 of a pair faces the first face 12 of a second heat exchanger plate 10 of the same pair. Then, the first heat exchanger plate 10 and the second heat exchanger plate 10 are brazed in order to delimit the canal 11.

In FIG. 3, the heat exchanger plate 10 extends between two lateral edges 14 and two longitudinal edges 15 of said heat exchanger plate 10. The lateral edges 14 and the longitudinal edges 15 are perpendicular to each other. The lateral edges 14 are parallel to each other and the longitudinal edges 14 are parallel to each other as well. The longitudinal edges 15 are longer than the lateral edges 14. All together the lateral edges 14 and the longitudinal edges 15 form a quadrilateral.

The heat exchanger plate 10 comprises four openings 16 that are extending from the first face 12 to the second face 13 of the heat exchanger plate 10 along the transversal direction A1. The openings 16 are located at the angle of the quadrilateral formed together by the lateral edges 14 and the longitudinal edges 15. The openings 16 can be either circular or elliptical. When two heat exchanger plates 10 are assembled together, the openings 16 are aligned along the transversal direction A1 to enable a fluid circulation from one tube 6 to another tube 6 within the heat exchanger 1. Therefore, the forms of the openings 16 of all the heat exchanger plates 10 are similar to permit such a refrigerant fluid circulation. Among the four openings 16, two of the openings 16 are close to a first lateral edge 14 and two of the openings 16 are close to a second lateral edge 14.

The heat exchanger plate 10 comprises a core portion 23 that is interposed between two collecting portions 25 gathering the openings 16. The core portion 23 of the heat exchanger plate 10 participates to the core 2 of the heat exchanger 1 that is receiving the corrugated fins 9 and where the heat transfer between the refrigerant fluid 4 and the air flow 5 mainly occur. The collecting portion 25 of the heat exchanger plate 10 participates to the part of the heat exchanger 1 that is collecting the refrigerant fluid 4 from one tube 6 to another tube 6.

The core portion 23 comprises a plurality of grooves 26 that are longitudinally extended in a parallel direction to the longitudinal edges 15. Some canals 11 are delimited by two grooves 26 and some canals 11 are delimited by a groove 16 and a longitudinal edge 25. Grooves 26 of two assembled heat exchanger plates are brazed together to delimit the canals 11. The grooves emerge over the second face 13 of the heat exchanger plate 10.

Each groove 26 extends from a first longitudinal extremity 33 and a second longitudinal extremity 32, both longitudinal extremities 32, 33 being located along a groove axis A4 that is parallel to the longitudinal edges 15 of the heat exchanger plate 10.

FIG. 4 shows that each opening 16 is delimited by a collar 17 that is arranged around the opening 16. Each collar 17 forms an extension of the heat exchanger plate 10 along the transversal direction A1 and around the opening 16. In other words, the collar forms a protrusion of the heat exchanger plate 10 over the first face 12 of the heat exchanger plate 10. The collars 17 of a heat exchanger plate 10 are all similar and are all extending from the second face 13 up to the first face 12.

The heat exchanger plate 10 comprises a plurality of dimples 18 that are protruding above the second face 13 of the heat exchanger plate 10. Each dimple 18 is a deformation of the heat exchanger plate 10 that extends from the first face 12 up to the second face 13. In other words, each dimple 18 forms a protrusion over the second face 13. That is to say that the dimples 18 and the collars 17 are formed in an opposite sense along the transversal direction A1. The grooves 26 and the dimples 18 emerge over the same face of the heat exchanger plate 10, i.e. the second face 13.

Each dimple 18 is located between the collar 17 and the core portion 23 of the heat exchanger plate 10, the dimple 18 and the core portion 23 being separated by a borderline 24. The borderline 24 is a limit of the heat exchanger plate 10 that is located between the collecting portion 25 of the heat exchanger plate 10 and the core portion 23 of said heat exchanger plate 10. The collecting portion 25 of the heat exchanger plate 10 comprises at least the collars 17. The flat area 19 of the dimple 18 is arranged in a first plane P1 that is parallel to a second plane P2 in which the core portion 23 of the heat exchanger plate 10 is arranged. The borderline 24 has a sinusoidal shape when observed from a view point located in a plane parallel to the second plane P2.

Each dimple 18 comprises a flat area 19 and a sloped area 20. The sloped area 20 is interposed between the collar 17 and the flat area 19. The flat area 19 is arranged in a plane that is parallel to the lateral plane P2. The sloped area 20 joins together the flat area 19 and the collar 17.

FIG. 5 represents a cross section of the dimple 18 taken in a central plane P3 that is perpendicular to the lateral plane P2 and that is passing through a center 21 of the opening 16. The sloped area 20 has a cross-section that has a S-shape form between the flat area 19 and the collar 17. The sloped area 20 comprises a fringe 22 that is tangent to the collar 17. The flat area 19 and the sloped area 20 form together an angle $\alpha$ that is different than 0°. The angle $\alpha$ is measured between both general extension directions of the flat area 19 and the sloped area 20.

The sloped area 20 is a curved area, the curvature center 29 of the curved area is located at a first distance D2 that is bigger than a depth P of the dimple 118. The depth P of the dimple 18 is measured between the first plane P1 and the second plane P2.

FIG. 6 features a heat exchanger plate 10 equipped with a plurality of dimples 18 whom sloped area 20 is delimited by two opposite side lines 27, a second distance D1 between the two side lines 27 increases from the flat area 19 of the dimple 18 up to the collar 17. That is to say that the distance D1 between two side lines 27 increases from a summit 28 of the dimple 18 up to the collar 17. Each side line 27 is a limit between the dimple 18 and the core portion 23 of the heat exchanger plate 10. Both opposite side lines 27 are parts of the borderline 24.

The dimples 18 are symmetrically arranged versus the central plane P3 that is parallel to the longitudinal edges 15 of the heat exchanger plate 10 and passing by the opening center 21 of the opening 16.

The summits 28 of the dimples 18 are arranged on a dimple circle 30, a center of the dimple circle 30 being the opening center 21.

A third distance D3 between the opening center 21 of the opening 16 and a limit 31 between the sloped area 20 and the flat area 19 is constant from one dimple 18 to another dimple 18. The third distance D3 between the opening center 21 of the opening 16 and the limit 31 between the sloped area 20 and the flat area 19 is taken between the opening center 21 of the opening 16 and a middle point 34 of the said limit 31, that is to say at equal distance of each side lines 27 of the sloped area 20.

As featured in FIG. 5, a thickness T of the sloped area 20 is at least constant from the limit 31 up to the collar 17. The thickness T of the sloped area 20 is measured between both faces 12, 13 of the heat exchanger plate 10 in the sloped area 20, perpendicularly of at least one face 12, 13. In another embodiment of the invention, the thickness T of the sloped area 20 is increasing from the limit 21 up to the collar 17.

The summit 28 of each dimple 18 is located in the canal 11 that is delimited by at least a groove 26.

In another embodiment of the invention, a dimple 18 is a prolongation of a groove 26. More precisely, the flat area 19 of the dimple 18 is a prolongation of a groove 26.

The dimple 18 comprises a chamfer 35, a width W of the chamfer 35 of the sloped area 20 being bigger than a width W of the chamfer 35 of the flat area 19.

The sloped area 20 and the flat area 19 are arranged around a line of symmetry 36 that is a curved line. In another embodiment of the invention, the sloped area 20 and the flat area 19 are arranged around a line of symmetry 36 that is a straight line.

The heat exchanger partially featured in FIG. 2 comprises a first heat exchanger plate 10 and a second heat exchanger plate 10 as described above, the flat area 19 of both heat exchanger plates 10 are in contact with each other. More precisely, the flat area 19 of both heat exchanger plates 10 are brazed together.

This comforts the resistance of the heat exchanger 1 during a pressure test in which the refrigerant fluid is at a pressure of 100 bars inside in the heat exchanger. Such a configuration of the heat exchanger 1 avoids any cracks within the heat exchanger plate 10 and any leaks of refrigerant fluid 4 from the heat exchanger 1.

Figure 7:
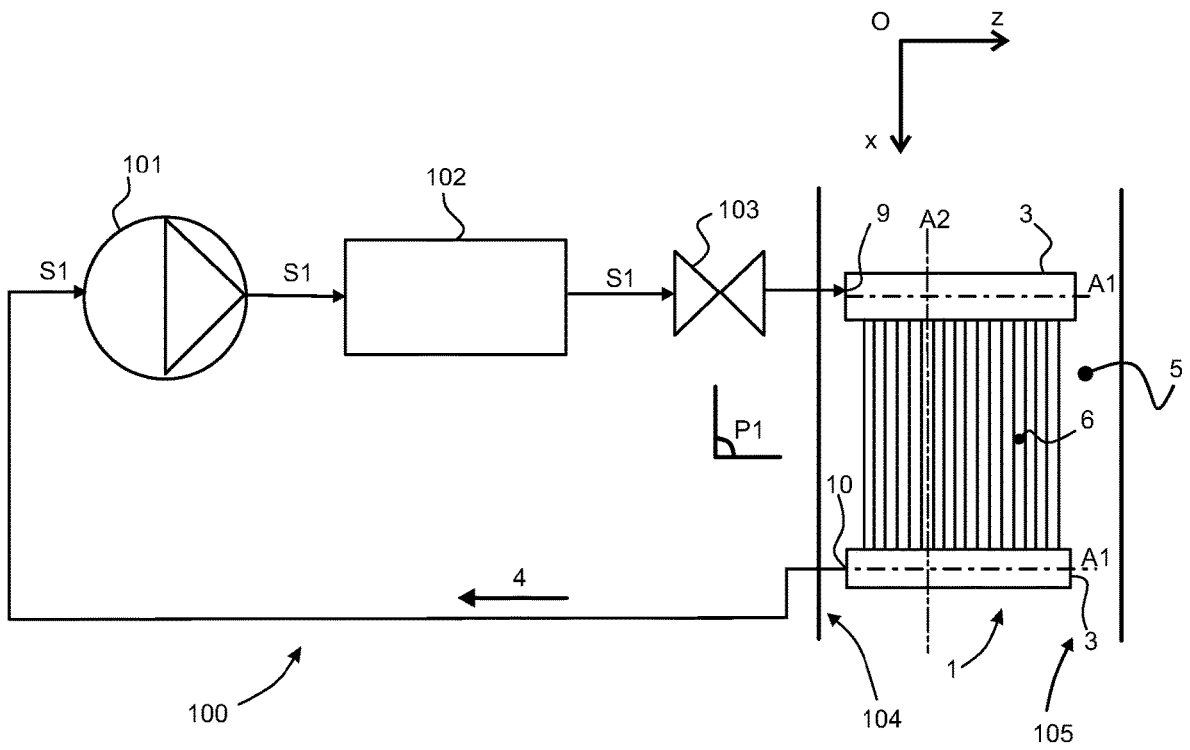

FIG. 7 illustrates a refrigerant fluid circulation circuit 100 inside which circulates the refrigerant fluid 4. Following a direction Si of circulation of the refrigerant fluid 4 inside the refrigerant fluid circulation circuit 100, the refrigerant fluid circulation circuit 100 successively comprises a compressor 101 for compressing the refrigerant fluid 4, a condenser or a gas cooler 102 for cooling the refrigerant fluid 4, an expansion device 103 inside which the refrigerant fluid 4 expands and the heat exchanger 1. The heat exchanger 1 is accommodated inside an air duct 104 of a heating, ventilating and air conditioning system 105 inside which circulates the air flow 5. The heat exchanger 1 allows a heat transfer between the refrigerant fluid 4 and the air flow 5 coming into contact with it and/or passing through it, as illustrated in FIG. 1. According to the operating mode of the refrigerant circuit 1 described above, the heat exchanger 1 is used as an evaporator for cooling the air flow 5, during the passage of the air flow 5 in contact with and/or from one side of the beat exchanger 1.

In view of the foregoing, proposed herein is a reinforced design of heat exchanger plate that is more resistant at working pressure and burst pressure in view of the sloped area that is interposed between the collar and the flat area of the dimple. The heat exchanger tube that uses such plate is easily manufactured, at a low cost. It allows good thermal exchange performance. This heat exchanger tube is dedicated to heat exchanger and can be found in a Heating, Ventilation and Air-Conditioning device of a motor vehicle. This kind of heat exchanger can be easily integrated into vehicle air conditioning systems in order to optimize the heat exchange between the air flow dedicated to the passenger compartment cool down and the refrigerant fluid circulating inside heat exchanger tubes of the invention.

However, the invention is not limited to resources and patterns described and illustrated here. It also includes all equivalent resources or patterns and every technical associations including such resources. More particularly, the shape of the heat exchanger plate does not affect the invention, insofar as the heat exchanger plate for use in a motor vehicle, in fine, has the same functionality as describes in this document.

The invention claimed is:

1. A heat exchanger plate of a heat exchanger, the heat exchanger plate comprising:

two faces extending between two lateral edges and two longitudinal edges of said heat exchanger plate;

an opening extending from a first face to a second face of the heat exchanger plate, the opening being delimited by a collar;

wherein the collar physically extends from the heat exchanger plate in a direction orthogonal to the first face of the heat exchanger plate and is arranged around the opening; and a plurality of dimples each protruding above at least one of the faces and extending away from the collar, wherein each of the dimples comprises at least a flat area and a sloped area, said sloped area being interposed between the collar and the flat area, wherein the sloped area extends away from the collar and the flat area extends away from the sloped area, whereby the flat area does not contact the collar, wherein each of the dimples extends from a summit to the collar, the summit being disposed radially away from the collar, wherein each of the dimples is delimited by two opposite side lines, and a first distance between both side lines increases from the summit up to the collar, through the flat area and the sloped area, and wherein the dimples are arranged symmetrically with respect to a central plane parallel to the two longitudinal edges and passing through a center of the opening.

2. The heat exchanger plate according to claim 1, wherein each of the dimples protrudes with respect to the second face of the heat exchanger plate.

3. The heat exchanger plate according to claim 1, wherein the sloped area is a curved area, and the curvature center of the curved area is located at a second distance that is bigger than a depth of each of the dimples.

4. The heat exchanger plate according to claim 1, wherein for each of the dimples the sloped area comprises a fringe that is tangent to the collar.

5. The heat exchanger plate according to claim 1, wherein, for each of the dimples, a third distance between the center of the opening and a limit between the sloped area and the flat area is constant from one dimple to another dimple.

6. The heat exchanger plate according to claim 1, wherein for each of the dimples a thickness of the sloped area is at least constant from a limit between the sloped area and the flat area up to the collar.

7. The heat exchanger plate according to claim 1, further comprising at least a groove that is located in a core portion of the heat exchanger plate.

8. The heat exchanger plate according to claim 7, wherein the summit of each of the dimples is located in a canal that is delimited by the at least a groove.

9. A heat exchanger comprising:

at least one heat exchanger plate comprising:

two faces extending between two lateral edges and two longitudinal edges of said heat exchanger plate, an opening extending from a first face to a second face of the heat exchanger plate, the opening being delimited by a collar;

wherein the collar physically extends from the heat exchanger plate in a direction orthogonal to the first face of the heat exchanger plate and is arranged around the opening; and a plurality of dimples each protruding above at least one of the faces and extending away from the collar, wherein each of the dimples comprises at least a flat area and a sloped area, said sloped area being interposed between the collar and the flat area, wherein the sloped area extends away from the collar and the flat area extends away from the sloped area, whereby the flat area does not contact the collar, wherein each of the dimples extends from a summit to the collar, the summit being disposed radially away from the collar, wherein each of the dimples is delimited by two opposite side lines, and a first distance between both side lines increases from the summit up to the collar, through the flat area and the sloped area, and wherein the dimples are arranged symmetrically with respect to a central plane parallel to the two longitudinal edges and passing through a center of the opening.

10. The heat exchanger according to claim 9, wherein the at least one heat exchanger plate comprises a first heat exchanger plate and a second heat exchanger plate, the flat area of both heat exchanger plates being in contact with each other.

* * * * *